United States Patent [19]

Gin

[11] Patent Number: 4,617,558

[45] Date of Patent: Oct. 14, 1986

[54] CONTAINER FOR SMALL CONSUMER ITEMS, SUCH AS HANDBAG, POUCH, PURSE, BOX OR THE LIKE, PROVIDED WITH ALARM

[76] Inventor: Abram Gin, 99-40 63 Rd., Rego Park, N.Y. 11374

[21] Appl. No.: 563,187

[22] Filed: Dec. 19, 1983

[51] Int. Cl.[4] ..... G08B 13/02

[52] U.S. Cl. ..... 340/574; 340/571

[58] Field of Search ..... 340/574, 571

[56] References Cited

U.S. PATENT DOCUMENTS

| | | | |
|---|---|---|---|
| 2,038,625 | 4/1936 | Adler | 340/571 |
| 3,701,140 | 10/1972 | Dixon | 340/571 |
| 4,272,763 | 6/1981 | Chang et al. | 340/571 |

*Primary Examiner*—Glen R. Swann, III

*Attorney, Agent, or Firm*—Ilya Zborovsky

[57] ABSTRACT

A container for small consumer items, such as a handbag, a pouch, a purse, a box etc, has a body part, a sound generating device arranged in said body part, an electric autonomous source for the sound generating device, and a switch actuatable by a user to activate the sound generating device.

5 Claims, 2 Drawing Figures

CONTAINER FOR SMALL CONSUMER ITEMS, SUCH AS HANDBAG, POUCH, PURSE, BOX OR THE LIKE, PROVIDED WITH ALARM

BACKGROUND OF THE INVENTION

The present invention deals with a container for small consumer items, such as a handbag, a purse, a pouch, a box and the like, which is generally held in hands or hangs on a shoulder etc.

Such containers often become a target of burglars who try to pull them from the user. At the present there is no means in these containers to prevent such burglaries or to at least scare a potential burglar. With increasing number of burglaries the problem of providing such means is to be solved to improve safety of the users.

SUMMARY OF THE INVENTION

Accordingly, it is an object of the present invention to provide a container for small consumer items such as a handbag, a purse, a pouch, a box and the like which avoids the disadvantages of the prior art.

More particularly, it is an object of the present invention to provide a container of the above mentioned general type, which scares a potential burglar and therefore increases safety of a container's user.

In keeping with these objects and with others which will become apparent hereinafter, one feature of the present invention resides, briefly stated, in a container of the above mentioned type which, in addition to its conventional body part which forms a compartment for small consumer items, has a signalling device arranged to generate an alarming sound, for example resembling the sound of a police siren, an autonomous electric current generating source for supplying the sound generating device, and a switch actuatable by a user so as to activate the sound generating device.

When the container is designed in accordance with these features, its user can activate a sound, for example resembling a police siren sound, in the event when a danger of burglary takes place, so that a potential burglar is scared away because of this sound or at least stopped, and also attention of passers-by is attracted.

The novel features of the present invention are set forth in particular in the appended claims. The invention itself, however, both as to its construction and as to its manner of operation will be best understood from the following description of a preferred embodiment, which is accompanied by the following drawing.

DESCRIPTION OF A PREFERRED EMBODIMENT

Figure 1:
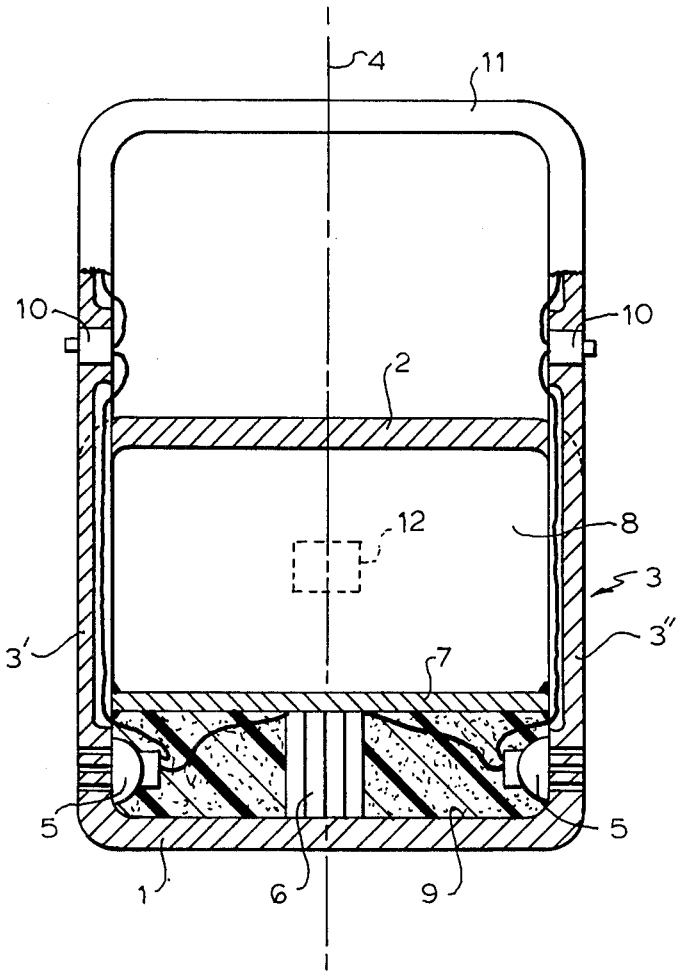
FIG. 1 is a partially sectioned side view of a handbag in accordance with the present invention.

A container for small consumer items is illustrated in the drawing as a handbag. The handbag has a bottom identified with reference numeral 1 and a top identified with reference numeral 2. They are spaced from one another in a vertical direction. A peripheral wall 3 is located between the top 2 and the bottom 1 and connects them with one another. The peripheral wall 3 can have, for example, four wall portions of which two wall portions 3' and 3'' are located at the left side and and the right side of a vertical axis of symmetry 4 of the handbag.

Two sound generating devices 5 are further provided. They are located in the region of the bottom 1 at opposite sides of the vertical axis of symmetry 4 and symmetrically relative to the latter. The sound generating devices 5 are associated with the respective wall portions 3' and 3''. A plurality of batteries are located in the region of the vertical axis of symmetry and symmetrically relative to the latter, as identified with reference numeral 6. The symmetrical location of the batteries 6 and the symmetrical location of the sound generating devices 5 provide for a weight balance of the handbag.

As can be seen from the drawing, a partition 7 subdivides the interior of the handbag into an upper compartment 8 and a lower compartment 9. The upper compartment 8 serves for accommodating consumer items, whereas the lower compartment 9 serves for accommodating the sound generating devices 5 and the batteries 6. The lower compartment 9 is filled with a material which tighly hold the above mentioned elements and also for insulating purposes. This material can be, for example, a foam plastic material.

The sound generating devices can be of a conventional construction. They can generate a sound resembling for example a police siren. For improving sound propagation, the wall portions 3' and 3'' can be provided in the regions of the outlets of the sound generating devices with a plurality of very small openings. The sound generating devices are connected by conductors with the batteries.

The partition 7 is fixedly connected with its one end to the wall portion 3''. The other end of the partition 7 is not connected with the wall portion 3'. Thereby the patition can be deflected so that in one position it separates the compartments 8 and 9 from one another, and in the other position after deflection it communicates said compartments with one another. In the latter case the elements 5 and 6 become easily accessible for mounting and dismounting purposes.

Figure 2:
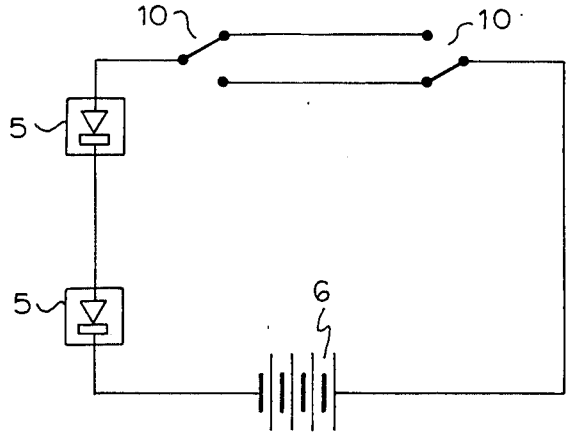
FIG. 2 is an electric diagram of a circuit utilized in the handbag of FIG. 1 in accordance with the present invention.

The handbag in accordance with the present invention is further provided with two switches identified with reference numeral 10. The switches 10 are connected with the circuit of the sound generating devices 5. As can be seen from the electric diagram of FIG. 2 the switches 10 are arranged so that whenever at least one switch is actuated by the user, it activates the sound generating device. The swtches are located at opposite sides of the handbag. More particularly, they are located at opposite sides of a handle 11 provided on the handbag. Such a location of the switches is very convenient, since a respective one of the switches can be reached by a left-handed user or a right-handed user. Moreover, regardless of the position of the handband, either with a lock 12 outside or the lock 12 inside, there will be always one switch located forwardly as considered in a walking direction, so that said one switch is reachable by the user.

The attachment of the respective elements to the walls of the handbag can be by any conventional means, such as by glueing, welding, sewing, etc. It is also to be understood that there can be only one signal generating device in the inventive handbag. It is also possible to have lower or greater number of electric batteries. The switches can be located not on the handle, but also on the body part of the handbag.

The invention is not limited to the details which are shown, since various modifications and structural changes can be possible without departing in any way from the spirit of the present invention.

What is desired to be protected by Letters Patents is set forth in particular in the appended claims hereinbelow.

I claim:

1. A container for small consumer items, such as a handbag, a pouch, a purse, a box or the like, comprising:

a body part forming a first compartment for accommodating small consumer items, and a second compartment separated from said first compartment by a partition, said body part having two opposite sides and a holding handle extending from one of said sides to the other of said sides;

a sound generating device arranged in said second compartment and operative for generating an alarming sound;

an autonomous electric current source arranged in said second compartment and supplying electric current to said sound generating device for generating the alarming sound by the latter; and switch means arranged to be actuated by a user so that when the user manually acts upon said switch means said electric current source is turned on and thereby said sound generating device generates the alarming sound, said switch means including two switching elements, each located on a respective one of said sides of said body so that when the user holds said holding handle with his or her one hand, the user can reach with his or her other hand a respective one of said switching elements regardless whether he or she is left-handed or right-handed.

2. A container as defined in claim 1, wherein said partition has two ends spaced from one another and arranged so that one of said ends is connected fixedly with said body part whereas the other of said ends is not fixedly immovably connected to the same, said partition is at least partially elastically deflectable at said one end thereof fixedly connected to the body part so as to move between a separating position in which it separates said compartments from one another for normal use of the container and a communicating position in which it communicates said compartments with one another for providing access to said second compartment.

3. A container as defined in claim 1, wherein the body part has a top and a bottom spaced from one another in a vertical direction, and a vertical axis of symmetry, said electric current source includes a plurality of electric batteries arranged at both sides of said axis of symmetry and symmetrically relative to the latter, said sound generating device including two sound generating elements one located on each side of said axis of symmetry symmetrically relative to the latter, and said electric batteries being located in the region of said vertical axis of symmetry while said sound generating elements are spaced from the latter, said electric batteries including at least two electric batteries one located on each side of said axis of symmetry and symmetrically relative to the latter, so that identical parts are located on each side of said axis of symmetry and therefore for weight balance of the container it is not necessary to deal with weight adjustment of different parts on both sides of said axis of symmetry.

4. A container as defined in claim 1; and further comprising packing means arranged in said second compartment around said sound generating device and said electric current source so as to tightly hold and insulate the latter.

5. A container for small consumer items, such as a handbag, a pouch, a purse, a box or the like, comprising a body part forming a first compartment for accommodating small consumer items, and a second compartment separated from said first compartment by a partition, said body part having a holding handle with two opposite sides;

a sound generating device arranged in said second compartment and operative for generating an alarming sound;

an autonomous electric current source arranged in said second compartment and supplying electric current to said sound generating device for generating the alarming sound by the latter; and switch means arranged to be actuated by a user so that when the user manually acts upon said switch means said electric current source is turned on and thereby said sound generating device generates the alarming sound, said switch means being arranged on said holding handle and including two switching elements, each located on a respective one of said sides of said handle of said body part so that when the user holds said holding handle with his or her one hand, the user can reach with his or her other hand a respective one of said switihing elements regardless whether he or she is left-handed or right-handed.

* * * * *